US007065902B2

(12) United States Patent
Williamson et al.

(10) Patent No.: US 7,065,902 B2
(45) Date of Patent: Jun. 27, 2006

(54) BLUEBERRY DRYER

(76) Inventors: Robert L. Williamson, 67602 - 62nd St., Hartford, MI (US) 49057; Luis M. Monterde, P.O. Box 1030, Purvis, MS (US) 39475

( * ) Notice: Subject to any disclaimer, the term of this patent is extended or adjusted under 35 U.S.C. 154(b) by 0 days.

(21) Appl. No.: 10/978,117

(22) Filed: Oct. 29, 2004

(65) Prior Publication Data

US 2006/0090366 A1 May 4, 2006

(51) Int. Cl.
*F26B 7/00* (2006.01)

(52) U.S. Cl. ..... 34/401; 34/429; 34/430; 34/433

(58) Field of Classification Search ..... 34/497, 34/401, 429, 430, 443, 433
See application file for complete search history.

(56) References Cited

U.S. PATENT DOCUMENTS

| | | | | |
|---|---|---|---|---|
| 3,797,567 | A * | 3/1974 | Wolf et al. | 165/120 |
| 4,321,031 | A * | 3/1982 | Woodgate | 432/11 |
| 5,537,757 | A * | 7/1996 | Gray | 34/164 |
| 5,913,590 | A * | 6/1999 | Backus | 34/401 |
| 5,924,217 | A * | 7/1999 | Peeters | 34/581 |

* cited by examiner

*Primary Examiner*—Kenneth Rinehart
(74) *Attorney, Agent, or Firm*—R. Tracy Crump

(57) ABSTRACT

A blueberry drying apparatus is disclosed that includes a longitudinally extending produce conveyer and a drying chamber through which the conveyer passes. The conveyer belt is constructed of a wire mesh, which allows air flow through the conveyer. The drying chamber includes two separate sets of fans. One set of fans is mounted above the conveyer and blows air directly onto the berries carried atop the conveyer. The other set of fans is mounted below the conveyer and draws air through the conveyer and around the berries.

15 Claims, 4 Drawing Sheets

BLUEBERRY DRYER

This invention relates to an apparatus for drying small produce, and specifically an apparatus for drying blueberries in an automated packaging process.

BACKGROUND OF THE INVENTION

Moisture on blueberries in the form of a watery film or water droplets is a significant problem for blueberry processors. Blueberries have a smooth skin with a waxy coating or bloom, which tends to hold moisture to the berry's skin. Moisture on the berries attracts and holds mold, yeast and bacteria, which results in spoilage. Since blueberries are typically cleaned and sanitized in a water bath or with a spray bar, the berries must be dried before packaging or further processing in order to minimize spoilage. Conventional blueberry drying apparatus use an array of fans to blow air onto the bulk blueberries carried atop a conveyer. While most drying apparatus employ high velocity fans and blowers, the air flow created by these dryers fail to complete dry the berries and simply blow the water droplets to the bottom side of the berries.

SUMMARY OF THE INVENTION

The present invention seeks to improve the airflow over the berries to facilitate the drying process. The blueberry dryer embodying the present invention includes a longitudinally extending produce conveyer and a drying chamber through which the conveyer passes. The conveyer belt is constructed of a wire mesh, which allows air flow through the conveyer. The drying chamber includes two separate sets of fans. One set of fans is mounted above the conveyer and blows air directly onto the berries carried atop the conveyer. The other set of fans is mounted below the conveyer and draws air through the conveyer and around the berries. The use of two sets of drying fans promotes tighter laminar airflow around the berries. In addition, the baffles inside the drying bay direct and channel the airflow from the fans and reduce turbulence which increases the volume of air moving around the berries through the conveyer. The present invention also includes a vibrator mechanism that vibrates the transport conveyer to shake the water droplets from the bottom of the berries.

Theses and other advantages of the present invention will become apparent from the following description with reference to the accompanying drawings.

BRIEF DESCRIPTION OF THE DRAWINGS

The accompanying drawings illustrate an embodiment of the present invention in which.

DESCRIPTION OF THE PREFERRED EMBODIMENT

Figure 1:
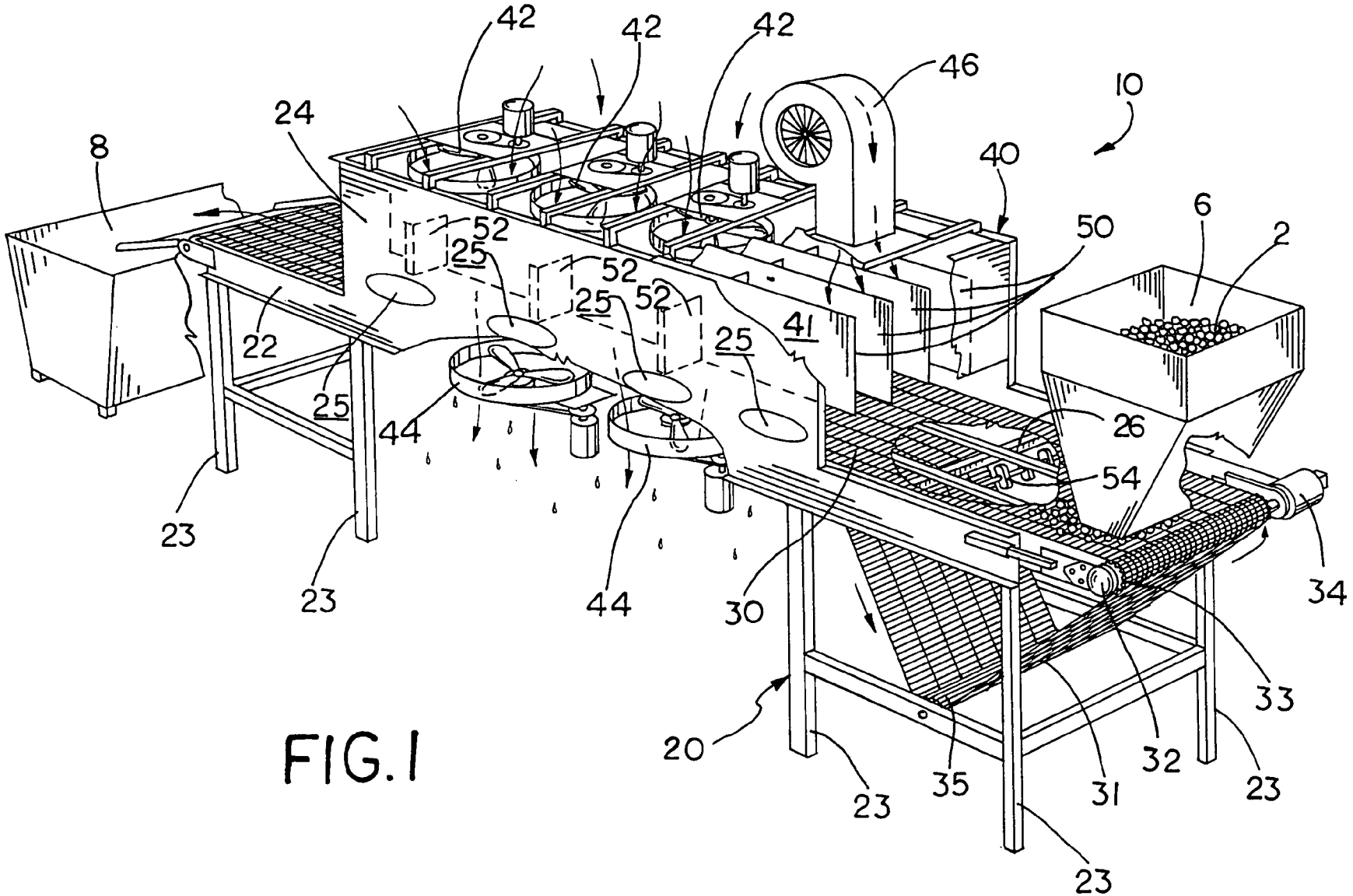
FIG. 1 is a perspective view of an embodiment of the invention.
Figure 2:
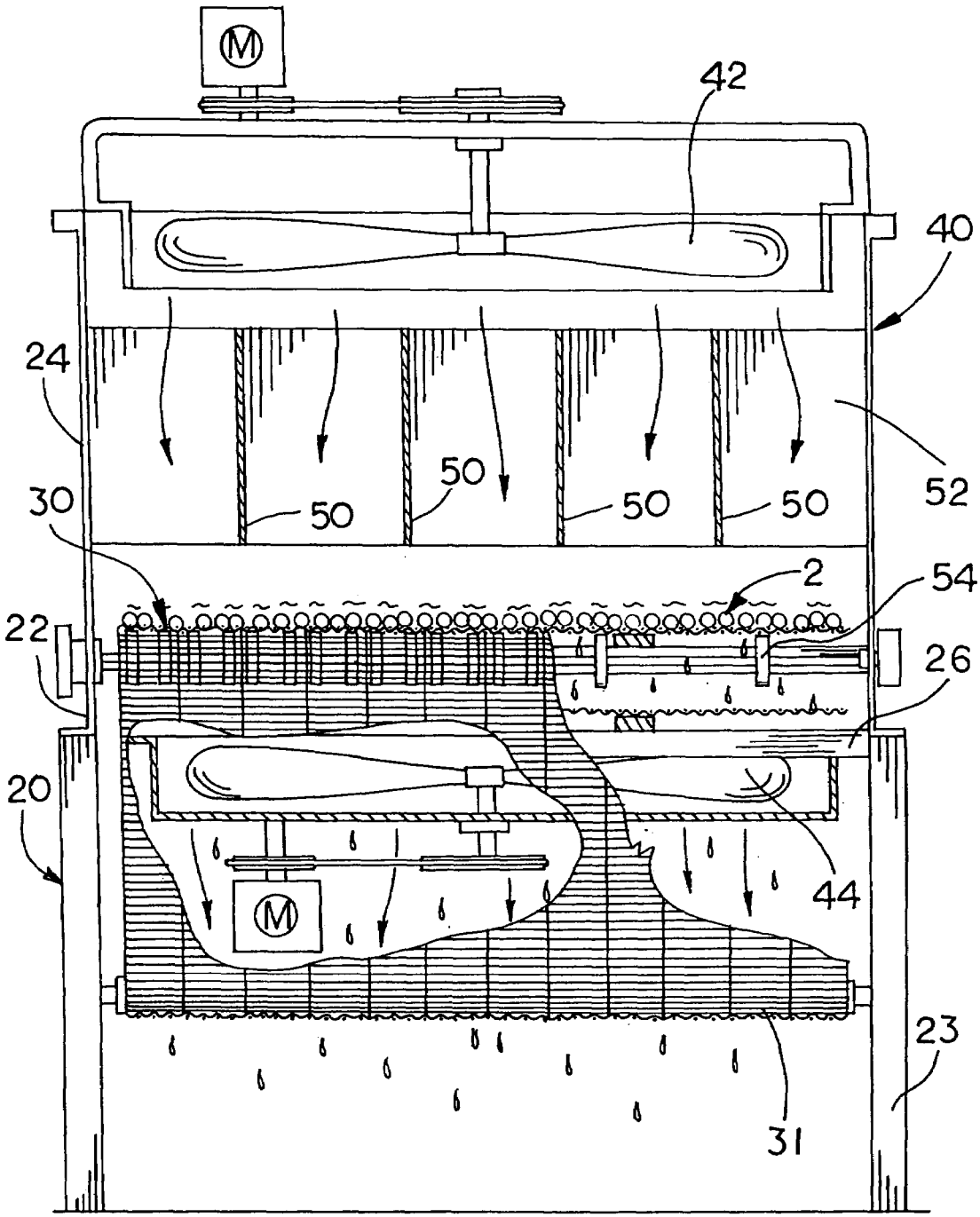
FIG. 2 is a front end view with portions cut way of the embodiment of FIG. 1 without the hopper shown.
Figure 3:
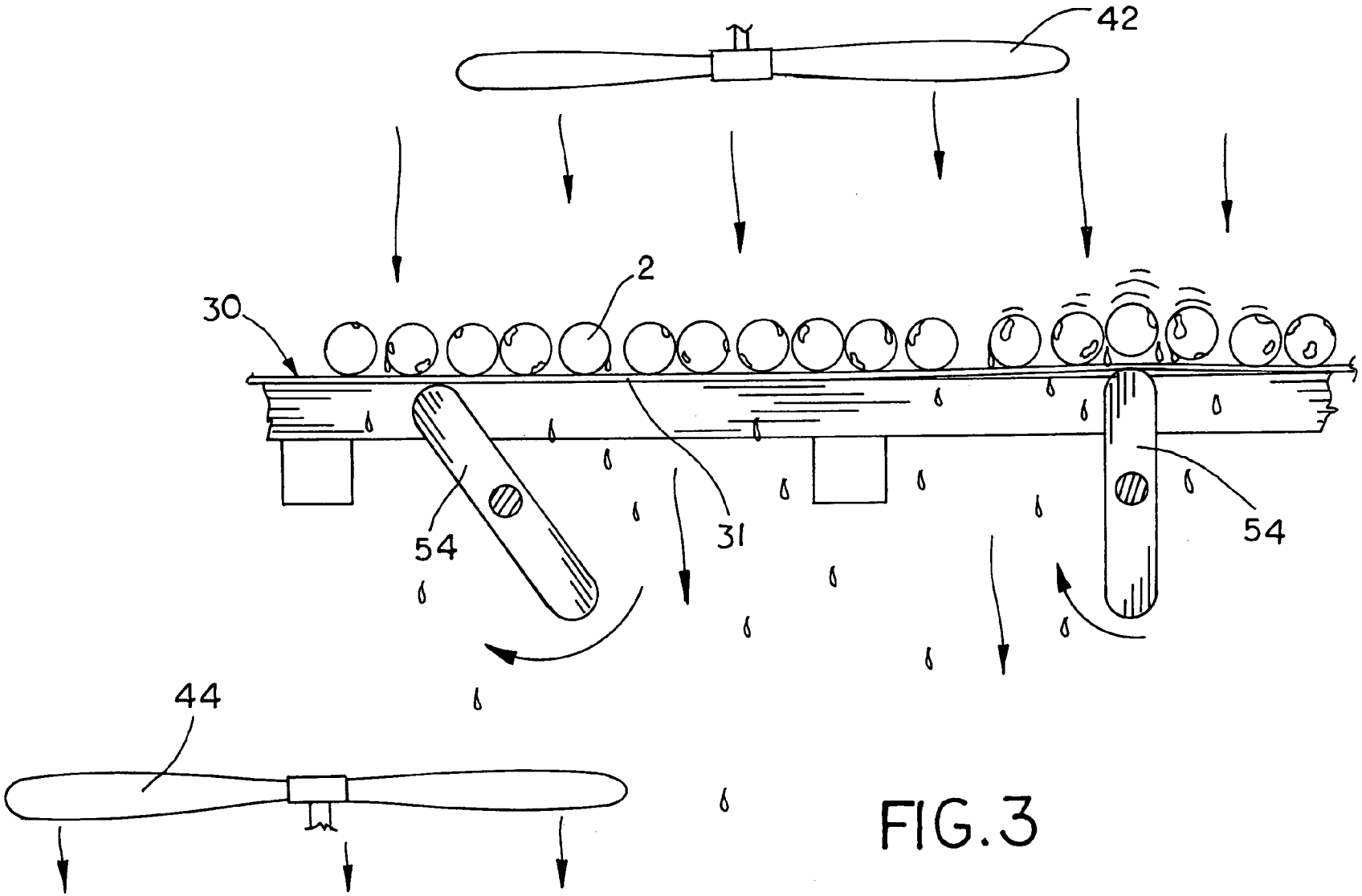
FIG. 3 is a simplified side sectional view of the conveyer, fans and vibrators of the embodiment of FIG. 1.
Figure 4:
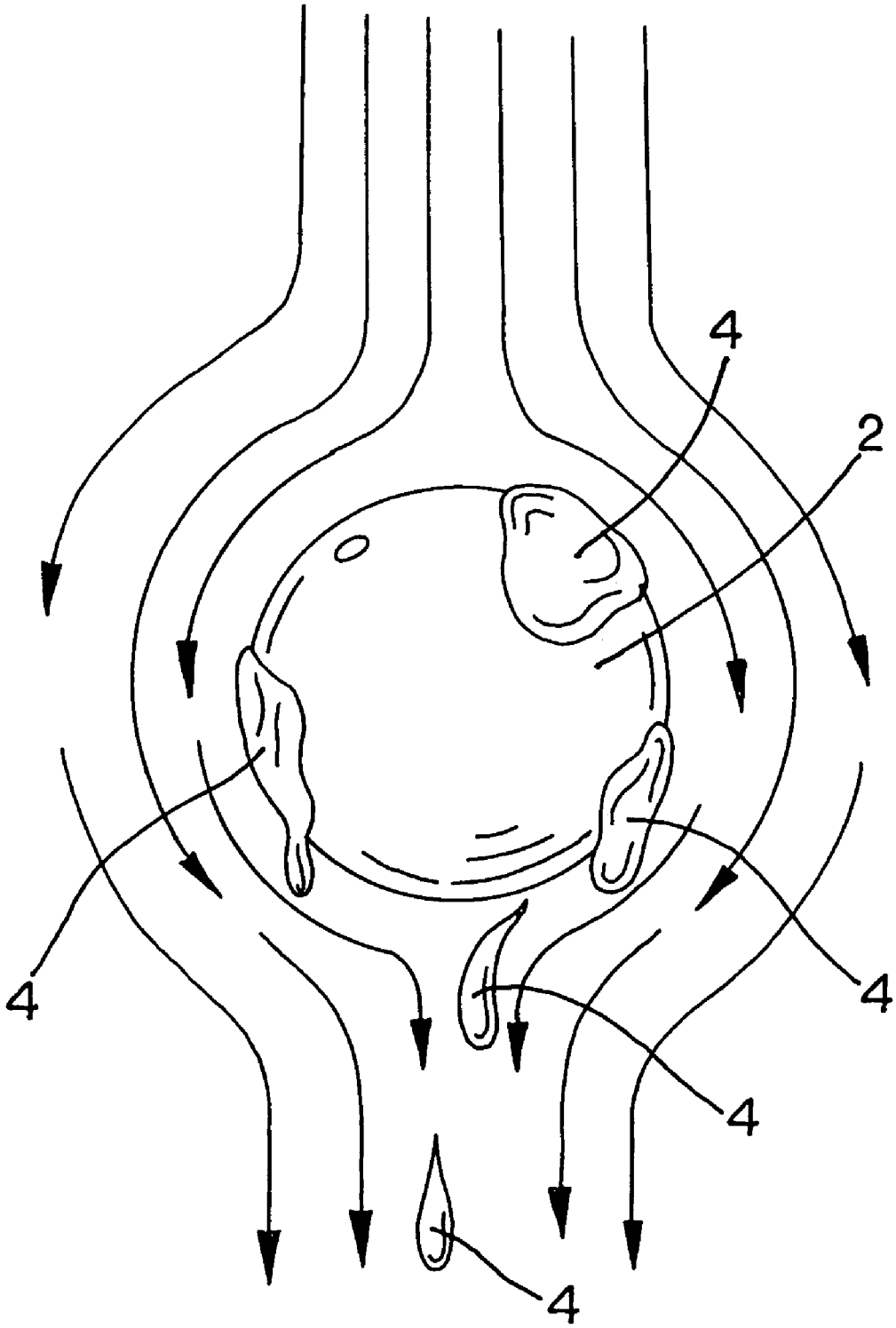
FIG. 4 is a simplified side view illustrating the laminar airflows around a blueberry facilitated by the present invention.

Referring now to the drawings, a blueberry drying apparatus, or simply "dryer" is designated generally as reference numeral 10. Dryer 10 includes a long drying chamber 40 and a produce conveyer 30 that extends longitudinally through the drying chamber. Conveyer 30 and drying chamber 40 are built on a table like frame 20, which includes two elevated side members 22 supported by eight upright legs 23. Frame 20 also includes various other beams, braces and supports to provide sufficient structural integrity to dryer 10.

Conveyer 30 is formed by a conveyer belt 31, which is trained about a plurality of traverse rollers and longitudinal rails mounted between side members 22. Conveyer belt 31 is constructed of a flexible stainless steel wire mesh, which allows airflow through the conveyer. While, conveyer belt 31 is illustrated with a wire mesh construction, any conveyer belt which allows air to pass therethrough may be employed. Drive rollers 32 are mounted at opposite ends of side members 22 and are operably connected to a variable speed electric motor 34 by a gear box, belt drive or other drive means. Each drive roller 32 has a toothed gear 33 at opposite ends of the roller, which mates with conveyer belt 31, so that rotation of the drive rollers 32 propels the conveyer belt 31 along the length of the conveyer. A tension roller 35 is shiftably mounted to frame 20 so that the tension of conveyer belt 31 can be adjusted.

Four paddle vibrators 54 are transversely mounted between side members 22 just below the top conveyer run. Each paddle vibrator 54 consists of a flat elongated paddle operatively connected to an electrical drive motor, which rotates the paddles about their longitudinal axises. When rotated, paddle vibrators 54 intermittently contact conveyer belt 31 to impart a slight vibration through the conveyer belt to berries 2. Typically, each paddle vibrator 54 is powered by one or more variable speed electric motor, which can be selectively controlled to vary the amount of vibrations generated.

Drying chamber 40 has an internal drying bay 41 defined by two sidewalls 24, which extend vertically from side members 22. Each sidewall 24 has a window 25 therein. Drying chamber 40 includes three upper drying fans 42, two lower drying fans 4 and a high velocity blower 46. As shown, upper fans 42 are suspended over conveyer 30 and lower fans 44 are suspended below conveyer 30. Fans 42 and blower 46 are mounted atop the open drying chamber 40 to cross members 28 that extend transversely between side walls 24. Fans 44 are mounted between side members 22. As shown, drying fans 42 and 44 are staggered longitudinally with respect to one another. Drying fans 42 and 44 both generate vertical air flows with fans 42 blowing air downward through conveyer 30 and fans 44 drawing air vertically through the conveyer. Typically, drying fans 42 and 44 are conventional electric powered axial or propeller fans, but any type of fan may be employed within the scope of this invention. Blower 46 is mounted above conveyer 30 at the front of drying bay 41. Blower 46 is illustrated as a conventional radial fan, but again any suitable type of fan may be employed within the scope of this invention. Drying chamber 40 also includes four longitudinal baffles 50, which extend the length of drying bay 41 and three lateral baffles 52, which extend the width of the drying bay. Baffles 50 and 52 reduce turbulence within drying bay 41 and direct the air flow downward through conveyer belt 31.

It should be noted that dryer 10 is designed to be used as a stand alone unit or as a component unit in an automated conveyer driven packaging system for drying bulk blueberries prior to packaging in individual containers. As part of an automated unit or system, typically all of the electrical drive motors of dryer 10 (conveyer, vibrators, fans and blowers motors) are wired to conventional electrical controller (not shown). While the electrical controller is not illustrated or described herein, such controllers are well known in the industry.

In operation, berries 2 are metered onto the top run of conveyer 30 from a hopper 6 located at the front of dryer 10. Conveyer 30 carries the berries through drying bay 41 from one end of dryer 10 to the other. Paddle vibrators 54 initially help spread berries 2 across the width of the top run of conveyer 30. More importantly, paddle vibrators 54 gently vibrate berries 2 to shake the water droplets 4 from the bottoms of the berries and continually turn the berries as they move through drying bay 41. Blower 46 provides the initial high velocity air flow to remove the largest water droplets 4 from berries 2. Within drying bay 41, drying fans 42 and 44 complete the drying process by simultaneously blowing air downward onto the tops of berries 2 and drawing air from the bottom of the berries. Drying fans 42 blow cool ambient air through conveyer belt 31 onto berries 2. Drying fans 44 pull air through conveyer belt 31 around berries 2, which facilitates a tighter laminar airflow around the individual berries. Facilitating tighter laminar airflow around the berries whisks more moisture off the berries and improves evaporation. Baffles 50 and 52 help direct and channel the airflow from drying fans 42 downward onto berries 2 and reduce turbulence within drying bay 41. At the end of dryer 10, conveyer 30 deposits the newly dried berries having emerged from drying chamber 40 into a collection bin 8 or some other conveyer or processing equipment as desired for the processing system.

ADVANTAGES

One skilled in the art will note that the present invention has several advantages over conventional dryers. The use of two sets of drying fans promotes tighter laminar airflow around the berries. In addition, the baffles inside the drying bay direct and channel the airflow from the fans and reduce turbulence which increases the volume of air moving around the berries through the conveyer. By improving air flow around the berries through the conveyer, the present invention improves the drying process. The paddle vibrators gently vibrate the berries to shake the water droplets from the bottom of the berries, which significantly improves the drying process.

The embodiment of the present invention herein described and illustrated is not intended to be exhaustive or to limit the invention to the precise form disclosed. It is presented to explain the invention so that others skilled in the art might utilize its teachings. The embodiment of the present invention may be modified within the scope of the following claims.

We claim:

1. An apparatus for removing moisture and water droplets from the surface of small produce, the apparatus comprising;

a frame having a first end and a second end;

a longitudinally extending conveyer supported by the frame for carrying the produce deposited thereupon from the first frame end to the second frame end, the conveyer allowing air to pass therethrough;

a first fan mounted to the frame over the conveyer;

a second fan mounted to the frame under the conveyer; and a plurality of baffles mounted to the frame and suspended between the first fan and the conveyer for directing air onto the produce carried atop the conveyer, one of the first fan and the second fan for blowing air onto the produce carried atop the conveyer, and the other of the first fan and the second fan for pulling air through the conveyer belt and around the produce carried atop the conveyer.

2. The apparatus of claim 1 wherein the first fan and the second fan constitute means for facilitating laminar air flow around the produce through the conveyer.

3. The apparatus of claim 1 wherein the conveyer includes a first roller, a second roller, a continuous conveyer belt constructed of a wire mesh and trained about the first and second rollers, and drive means for propelling the conveyer belt about said first and second roller shafts.

4. The apparatus of claim 1 and means for vibrating the conveyer under the first fan so as to shake the moisture and the water droplets from the produce.

5. An apparatus for drying bulk quantities of small produce, the apparatus comprising;

a drying chamber defining an open drying bay having a first end and a second end; and a longitudinally extending conveyer through the drying bay for carrying the produce deposited through the drying bay, the conveyer allowing air to pass therethrough;

the drying chamber includes a first fan mounted to a frame over the conveyer and a second fan mounted to the frame beneath the conveyer, one of the first fan and the second fan for blowing air onto the produce carried atop the conveyer, and the other of the first fan and the second fan for pulling air through the conveyer belt and around the produce carried atop the conveyer; and a plurality of baffles mounted to the frame and suspended between the first fan and the conveyer for directing air onto the produce carried atop the conveyer.

6. The apparatus of claim 5 wherein the first fan and the second fan constitute means for facilitating laminar air flow around the produce through the conveyer.

7. The apparatus of claim 5 wherein the conveyer includes a first roller, a second roller, a continuous conveyer belt constructed of a wire mesh and trained about the first and second rollers, and drive means for propelling the conveyer belt about said first and second roller shafts.

8. The apparatus of claim 5 and means for vibrating the conveyer under the first fan so as to shake the moisture and the water droplets from the produce.

9. A drying apparatus for removing moisture and water droplets from the surface of blueberries, the apparatus comprising;

a frame having a first end and a second end;

a drying chamber supported atop the frame between the first frame end and the second frame end, the drying chamber defining an open drying bay therein;

a longitudinal conveyer supported by the frame and extending through the drying bay for carrying the bulk blueberries deposited thereupon through the drying chamber from the first frame end to the second frame end; and means for vibrating the conveyer under the first fan so as to shake the moisture and the water droplets from the produce, the conveyer allowing air to pass therethrough, the drying chamber includes a first fan mounted to the frame over the conveyer for blowing air onto the bulk blueberries carried atop the conveyer, a second fan mounted to the frame beneath the conveyer for pulling air through the conveyer belt and around individual berries of the bulk blueberries carried atop the conveyer, and a plurality of baffles suspended between the first fan and the conveyer for directing air onto the bulk blueberries carried atop the conveyer.

10. An apparatus for removing moisture and water droplets from the surface of small produce, the apparatus comprising;

a frame having a first end and a second end;

a longitudinally extending conveyer supported by the frame for carrying the produce deposited thereupon from the first frame end to the second frame end, the conveyer allowing air to pass therethrough;

a first fan mounted to the frame over the conveyer;

a second fan mounted to the frame under the conveyer, one of the first fan and the second fan for blowing air onto the produce carried atop the conveyer, and the other of the first fan and the second fan for pulling air through the conveyer belt and around the produce carried atop the conveyer; and means for vibrating the conveyer under the first fan so as to shake the moisture and the water droplets from the produce.

11. The apparatus of claim 10 wherein the first fan and the second fan constitutes means for facilitating laminar air flow around the produce through the conveyer.

12. The apparatus of claim 10 wherein the conveyer includes a first roller, a second roller, a continuous conveyer belt constructed of a wire mesh and trained about the first and second rollers, and drive means for propelling the conveyer belt about said first and second roller shafts.

13. An apparatus for drying bulk quantities of small produce, the apparatus comprising:

a drying chamber defining an open drying bay having a first end and a second end; and a longitudinally extending conveyer through the drying bay for carrying the produce deposited through the drying bay, the conveyer allowing air to pass therethrough;

the drying chamber includes a first fan mounted to a frame over the conveyer and a second fan mounted to the frame beneath the conveyer, one of the first fan and the second fan for blowing air onto the produce carried atop the conveyer, and the other of the first fan and the second fan for pulling air through the conveyer belt and around the produce carried atop the conveyer, the drying chamber also includes means for vibrating the conveyer under the first fan so as to shake the moisture and the water droplets from the produce.

14. The apparatus of claim 13 wherein the first fan and the second fan constitutes means for facilitating laminar air flow around the produce through the conveyer.

15. The apparatus of claim 13 wherein the conveyer includes a first roller, a second roller, a continuous conveyer belt constructed of a wire mesh and trained about the first and second rollers, and drive means for propelling the conveyer belt about said first and second roller shafts.

* * * * *